US008141204B2

(12) United States Patent
Chiang

(10) Patent No.: US 8,141,204 B2
(45) Date of Patent: Mar. 27, 2012

(54) SAFETY STRUCTURE OF AN AUTO-EJECT PULL HANDLE FOR TRAVEL BAG

(75) Inventor: Hsi-Wu Chiang, Taichung (TW)

(73) Assignee: C & C Luggage Manufacturing Co., Ltd., Taichung (TW)

( * ) Notice: Subject to any disclaimer, the term of this patent is extended or adjusted under 35 U.S.C. 154(b) by 420 days.

(21) Appl. No.: 12/385,808

(22) Filed: Apr. 21, 2009

(65) Prior Publication Data

US 2010/0088848 A1 Apr. 15, 2010

(30) Foreign Application Priority Data

Oct. 9, 2008 (TW) ..... 97139085 A

(51) Int. Cl.
*A47B 95/02* (2006.01)

(52) U.S. Cl. ..... 16/113.1; 16/110.1; 16/111.1

(58) Field of Classification Search ..... 16/110.1, 16/111.1, 113.1, 405, 429, 411; 379/451, 379/433.12, 437; 200/334; 190/115, 118; 42/70.01; 280/37, 655.1
See application file for complete search history.

(56) References Cited

U.S. PATENT DOCUMENTS

| | | | | |
|---|---|---|---|---|
| 5,021,616 | A * | 6/1991 | Hardt | 200/334 |
| 5,533,601 | A * | 7/1996 | Wang | 190/115 |
| 5,816,374 | A * | 10/1998 | Hsien | 190/115 |
| 5,924,169 | A * | 7/1999 | Lu | 16/405 |
| 6,332,242 | B1 * | 12/2001 | Chen | 16/113.1 |
| 6,769,157 | B1 * | 8/2004 | Meal | 24/633 |
| 6,918,475 | B2 * | 7/2005 | Lin et al. | 190/115 |
| 6,919,817 | B2 * | 7/2005 | Choi et al. | 340/12.51 |
| 2003/0024071 | A1 * | 2/2003 | Wang | 16/113.1 |
| 2004/0025914 | A1 * | 2/2004 | Kuo | 135/24 |
| 2004/0231939 | A1 * | 11/2004 | Miyoshi | 190/115 |

* cited by examiner

*Primary Examiner* — Victor Batson
*Assistant Examiner* — Jeffrey O Brien
(74) *Attorney, Agent, or Firm* — Bacon & Thomas, PLLC

(57) ABSTRACT

Installed in an auto-eject pull handle that is mounted in a travel bag and ejectable out of the travel bag to a predetermined elevation by an ejecting mechanism subject to the control of a control button, a safety structure includes a holder member that has an opening that accommodates the control button, and a sliding cover coupled to the holder member and slidable to between a closed position to keep the control button from sight and an open position to let the control button be exposed to the outside for operation.

6 Claims, 8 Drawing Sheets

SAFETY STRUCTURE OF AN AUTO-EJECT PULL HANDLE FOR TRAVEL BAG

BACKGROUND OF THE INVENTION

1. Field of the Invention

The present invention relates to an auto-eject pull handle for a travel bag and more particularly, to a safety structure installed in an auto-eject pull handle for a travel bag to prohibit accidental ejection of the pull handle.

2. Description of the Related Art

The design of a travel bag must consider many factors. In addition to light and durable characteristics, the factor of ease-of-use is also important.

For example, a travel bag is usually equipped with a retractable pull handle to facilitate hand carrying. As shown in FIG. 1, the retractable pull handle 1 is installed in the back side of the travel bag. When not in use, the retractable pull handle 1 is received inside the housing 2 of the travel bag with the grip 1*a* exposed to the outside. The housing 2 has a top recess 2*a* for accommodating the grip 1*a*, maintaining the whole sense of beauty of the travel bag.

However, the limited space between the grip 1*a* and the bottom wall 2*b* of the top recess 2*a* does not allow insertion of a hand. Pulling the grip 1*a* out of the top recess 2*a* is not easy. To overcome this problem, an ejecting mechanism (not shown) is provided and locked in the pull handle 1. By means of pressing a control button 3 to unlock the ejecting mechanism, the ejecting mechanism ejects the pull handle 1 upwards from the top recess 2*a* to a predetermined elevation (see the imaginary line shown in FIG. 1). Thus, a big space is left between the grip 1*a* and the bottom wall 2*b* of the top recess 2*a* for the insertion of a hand to pull the pull handle 1 to the extended position.

According to the aforesaid arrangement, the control button 3 is exposed to the outside for convenient operation. Because no safety means is provided to prohibit accidental triggering of the control button 3, the control button 3 may be forced to unlock the ejecting mechanism accidentally by an external force, causing an accidental ejection of the pull handle 1. Therefore, an improvement in this regard is necessary.

SUMMARY OF THE INVENTION

The present invention has been accomplished under the circumstances in view. It is therefore the main object of the present invention to provide a safety structure for an auto-eject pull handle for a travel bag, which prohibits accidental ejection of the auto-eject pull handle. It is another object of the present invention to provide a safety structure for an auto-eject pull handle for a travel bag, which has the advantage of ease of use.

To achieve these and other objects of the present invention, a safety structure is installed in an auto-eject pull handle that is mounted in a travel bag and ejectable out of the travel bag to a predetermined elevation by an ejecting mechanism of the travel bag subject to the control of a control button. The safety structure comprises a holder member, which comprises a sliding track and an opening formed in the sliding track for accommodating the control button, and a sliding cover, which is coupled to the sliding track and movable along the sliding track between a closed position where the sliding cover covers the opening to keep the control button from sight and an open position where the sliding cover is kept away from the opening to let the control button be exposed to the outside for operation.

DETAILED DESCRIPTION OF THE INVENTION

A safety structure of an auto-eject pull handle in accordance with the present invention is used in a travel bag in which a button is provided for pressing by the user to unlock an ejecting mechanism, enabling the ejecting mechanism to eject the pull handle out of the travel bag to a predetermined elevation so that the user can pull the pull handle to the fully extended position conveniently for use. Because the ejecting mechanism is of the known art and not within the scope of the claims of the present invention, no further detailed description in this regard is necessary. The structural arrangement and functioning of the safety structure and the relationship between the safety structure and the control button will be explained hereinafter.

Figure 1:
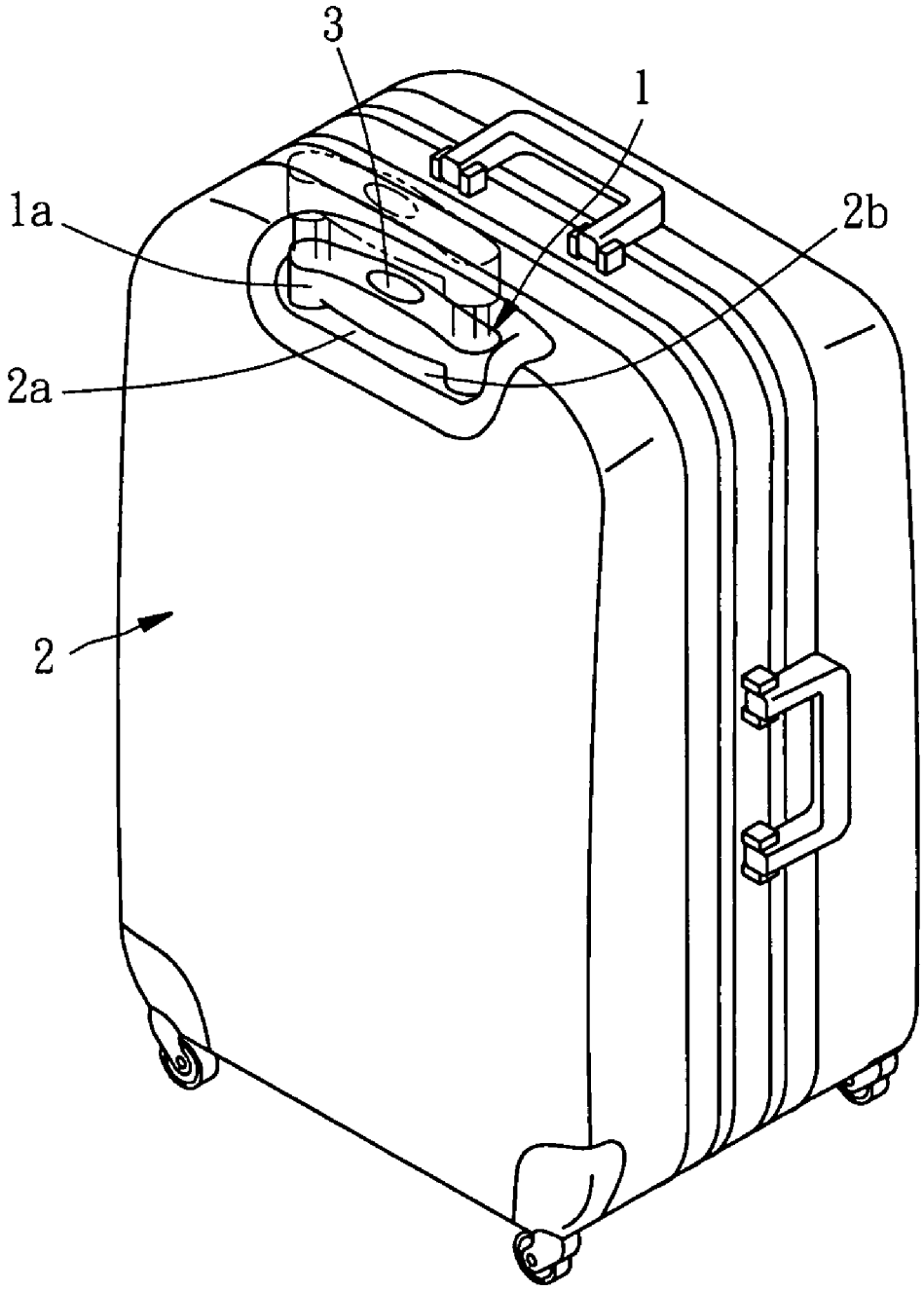
FIG. 1 PRIOR ART
FIG. 1 is a schematic drawing showing a conventional travel bag with an auto-eject pull handle.
Figure 2:
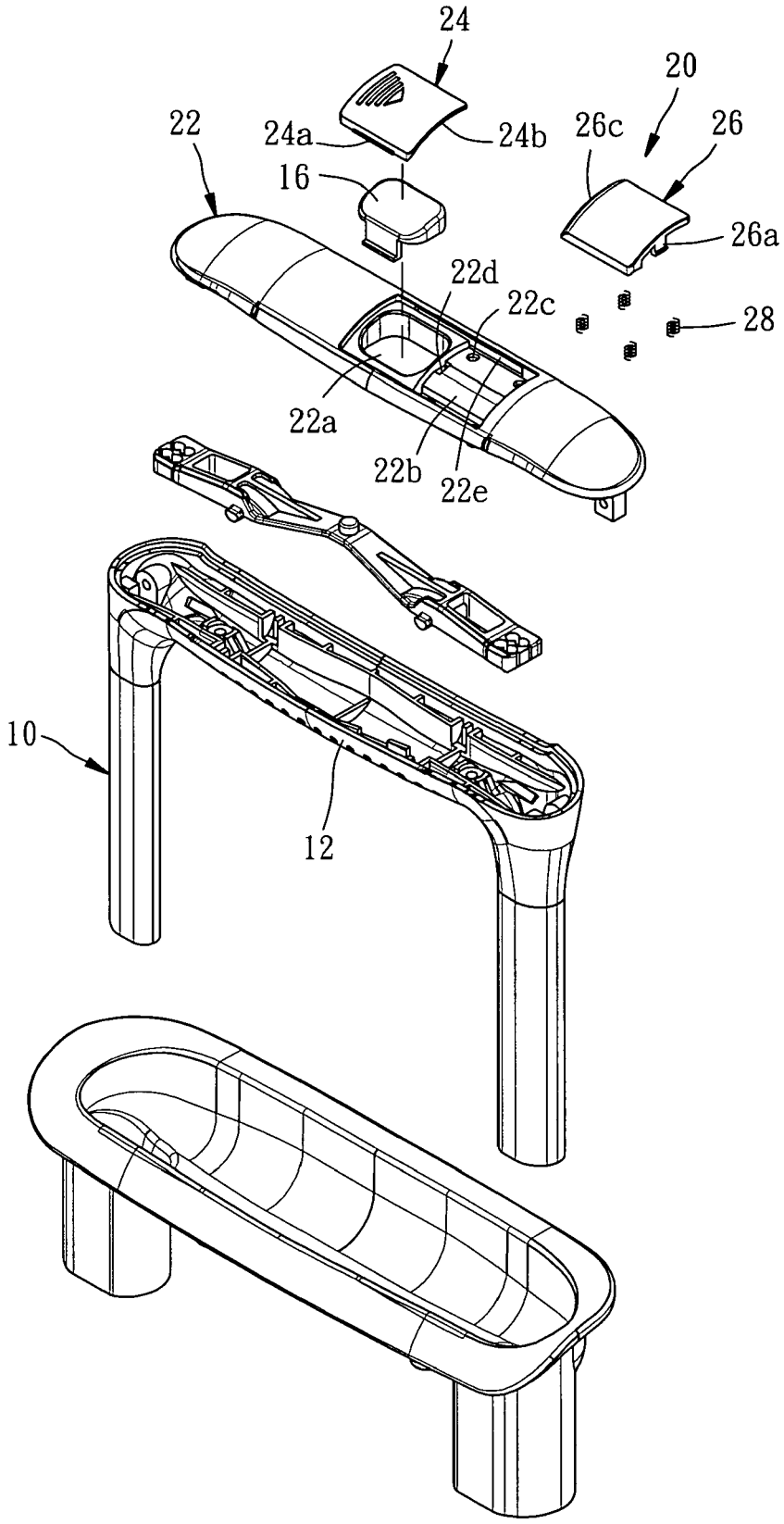
FIG. 2 is an exploded view of a safety structure of an auto-eject pull handle in accordance with the present invention.
Figure 3:
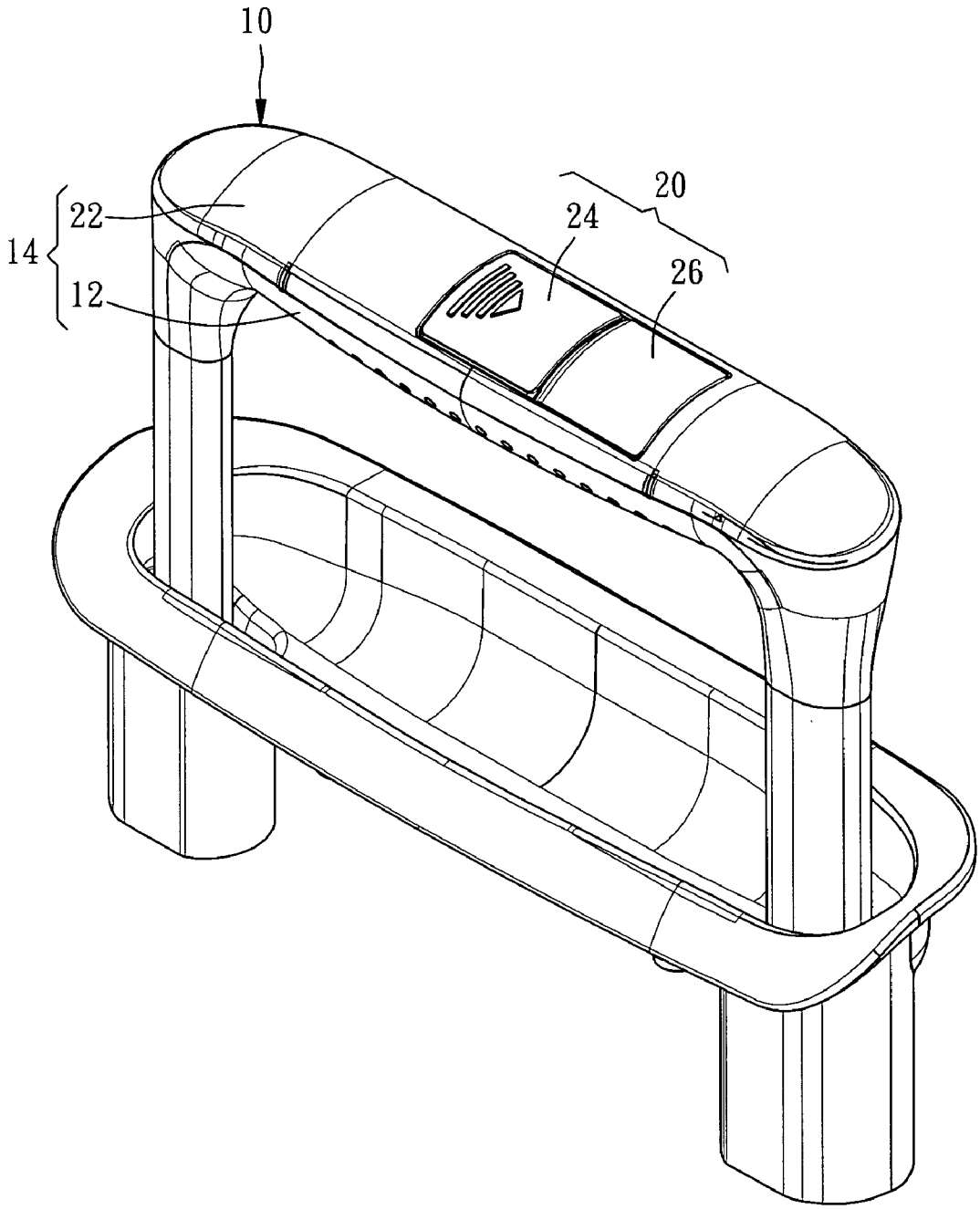
FIG. 3 is an elevational assembly view of the safety structure of the auto-eject pull handle in accordance with the present invention.
Figure 4:
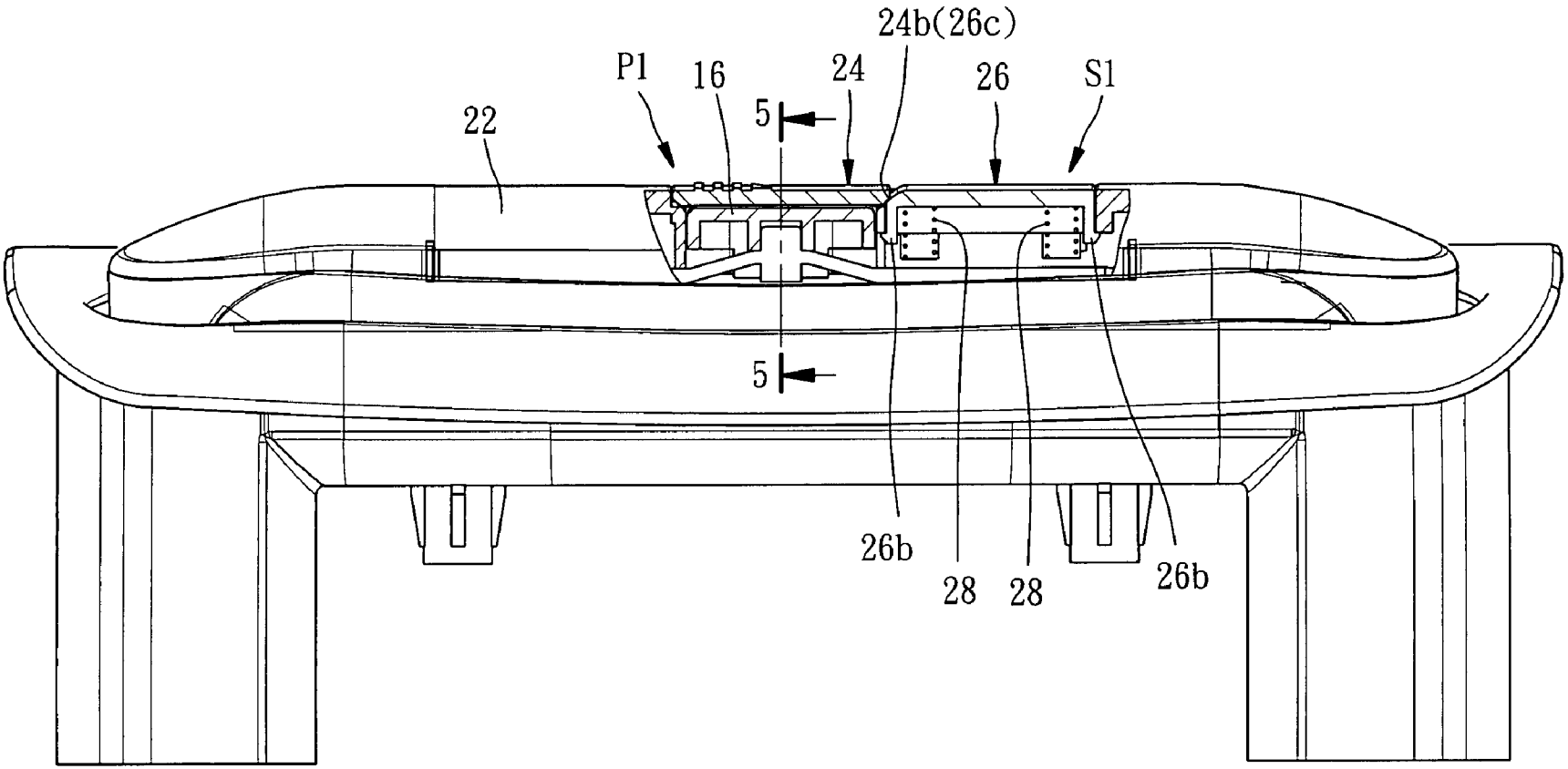
FIG. 4 is a sectional view side view of the safety structure of the auto-eject pull handle in accordance with the present invention, showing the control button kept from sight.

Referring to FIGS. 2~4, the safety structure, referenced by 20, is installed in the pull handle, referenced by 10, and adapted to prohibit accidental ejection of the pull handle 10. The safety structure 20 includes a holder member 22, a sliding cover 24, and ornamental plate 26, and four elastic means, for example, spring members 28.

The holder member 22 is a plate member covered on a base frame 12, thereby forming a grip 14 of the pull handle 10. The aforesaid ejecting mechanism has a part mounted in between the holder member 22 and the base frame 12, i.e., the inside space of the grip 14. The holder member 22 has an opening 22*a* cut through the top and bottom walls thereof on the middle for accommodating the control button 16 that is operable to unlock the ejecting mechanism, an open chamber 22*b* upwardly formed in the top wall of the holder member 22 and disposed adjacent to one lateral side of the opening 22*a*, four countersunk holes 22*c* respectively disposed in the four corners inside the open chamber 22*b*, and two locating holes 22*d* respectively formed in the open chamber 22*b* at two opposite lateral sides and cut through the bottom wall of the holder member 22, and two sliding grooves 22*e* respectively formed in the top wall of the holder member 22 in a parallel manner at the front and rear sides relative to the opening 22*a* and the open chamber 22*b*. The sliding grooves 22*e* constitute a sliding track for the sliding of the sliding cover 24.

Figure 5:
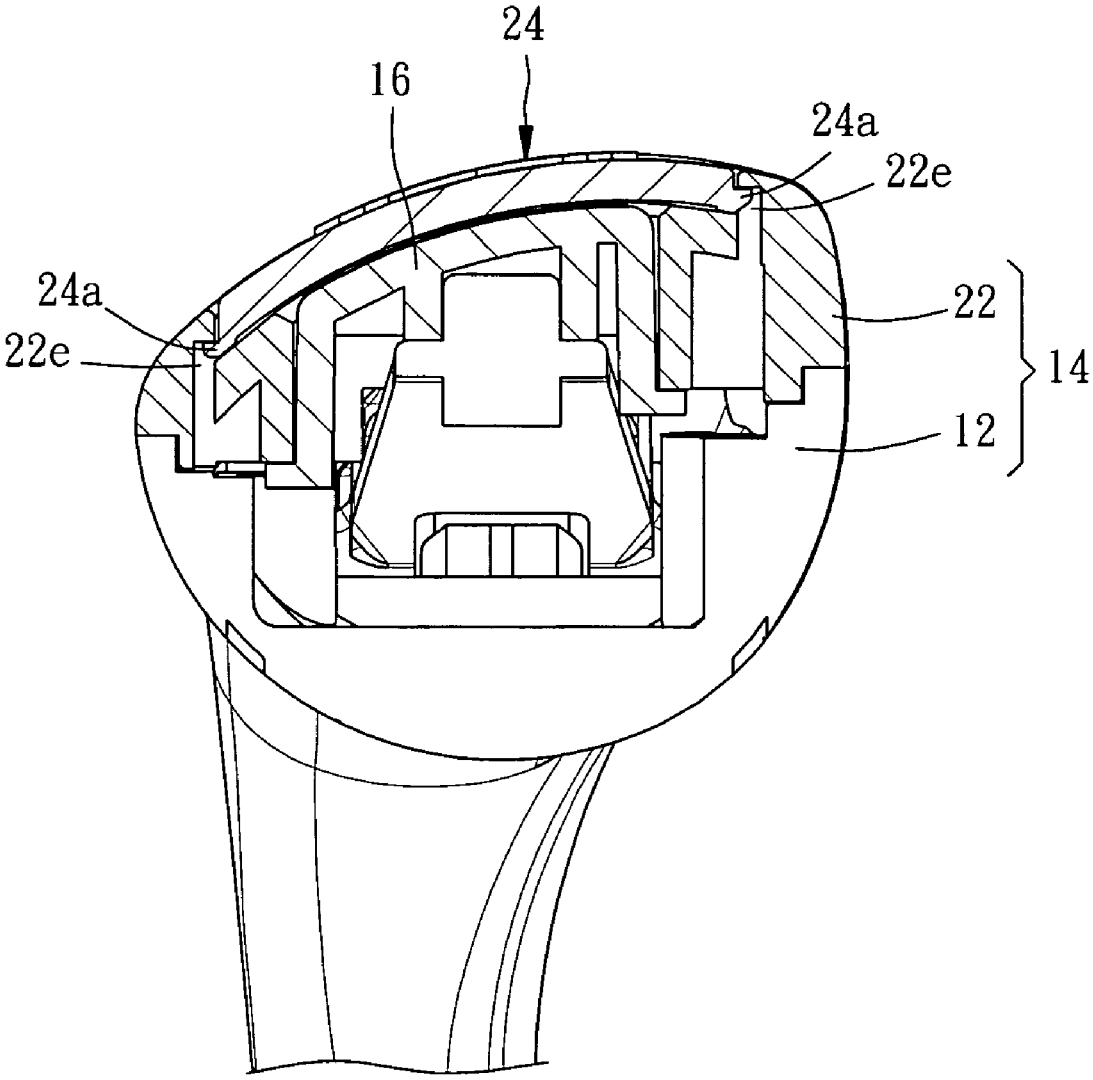
FIG. 5 is a cross-sectional view taken along line 5-5 of FIG. 4.
Figure 6:
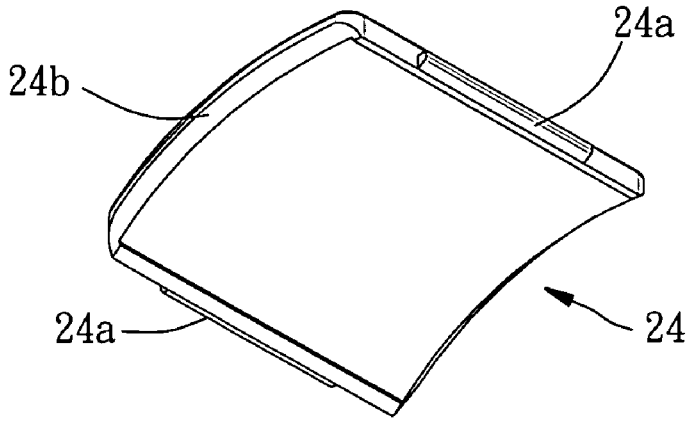
FIG. 6 is an elevational view of the sliding cover for the safety structure of the auto-eject pull handle in accordance with the present invention.

Referring to FIGS. 5 and 6, the sliding cover 24 is a smoothly arched plate member having two rails 24*a* arranged in parallel at the front and rear sides thereof and respectively slidably coupled to the sliding grooves 22*e* of the holder member 22.

Figure 9:
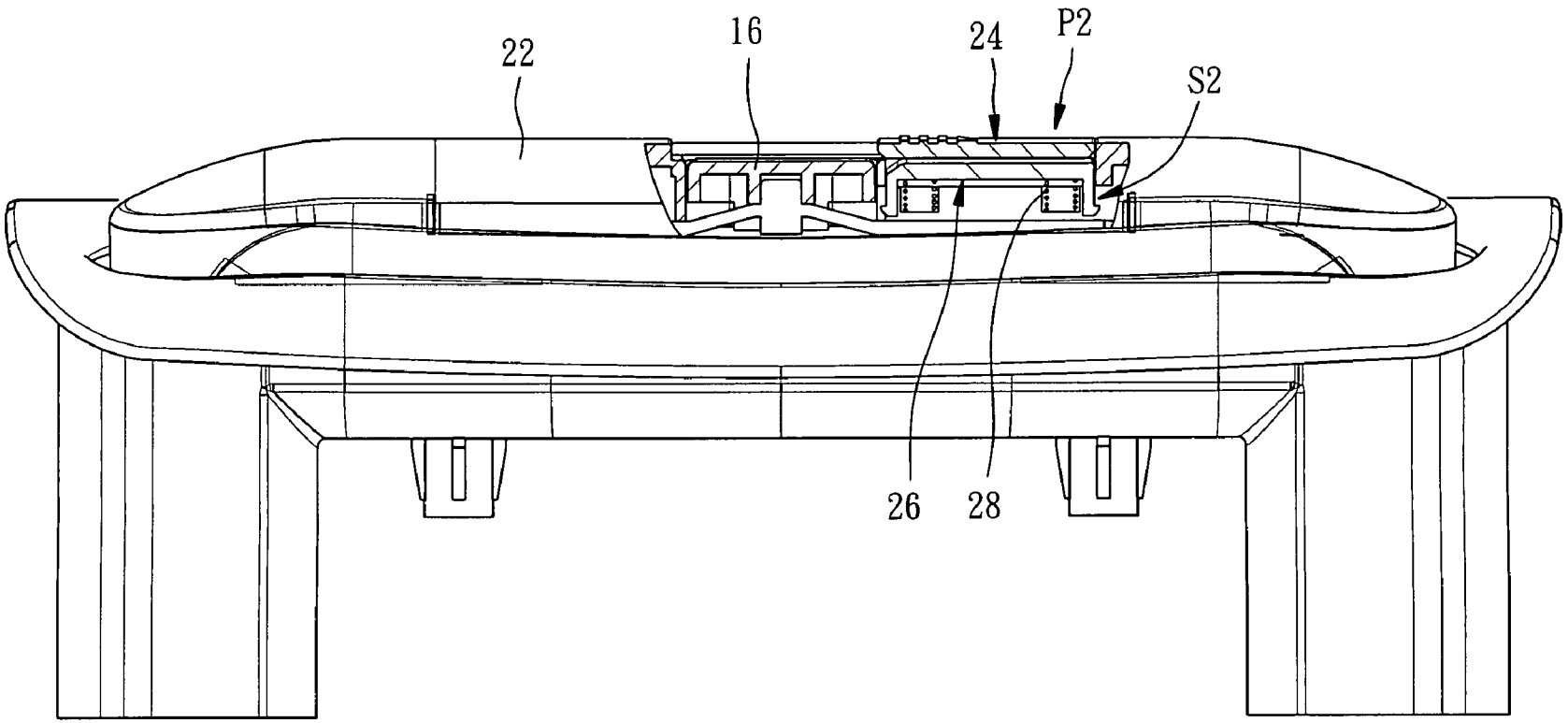
FIG. 9 is similar to FIG. 4 but showing the control button exposed to the outside.

Therefore, the sliding cover 24 can be moved along the sliding track of the sliding grooves 22*e* between a closed position P1 shown in FIG. 4 and an open position P2 shown in FIG. 9. The sliding cover 24 further has a beveled edge 24*b* at one lateral side thereof.

Figure 7:
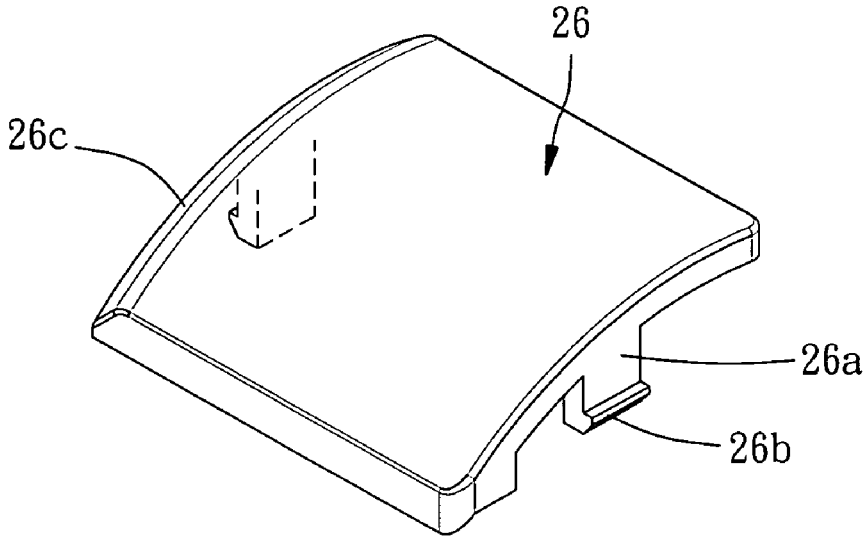
FIG. 7 is a perspective view of the ornamental plate for the safety structure of the auto-eject pull handle in accordance with the present invention.

Referring to FIG. 7, the ornamental plate 26 is a smoothly arched plate member having two bottom hook rods 26*a* respectively protruded from the bottom wall thereof at two opposite lateral sides and respectively terminating in a respective hooked portion 26*b*. The two bottom hook rods 26*a* of the ornamental plate 26 are respectively inserted through the two locating holes 22*d* of the holder member 22 to secure the ornamental plate 26 to the holder member 22. By means of stopping the hooked portions 26*b* of the bottom hook rods 26*a* at the bottom wall of the holder member 22, the ornamental plate 26 is prohibited from falling away from the holder member 22. The ornamental plate 26 further has a beveled edge 26*c* disposed at one lateral side thereof and matching the beveled edge 24*b* of the sliding cover 24. After installation of the ornamental plate 26 in the holder member 22, the ornamental plate 26 can only be moved vertically relative to the holder member 22 between a first position S1 shown in FIG. 4 and a second position S2 shown in FIG. 9.

The four spring members 28 are respectively mounted between the holder member 22 and the ornamental plate 26, each having one end respectively positioned in the countersunk holes 22*c* and the other end stopped against the bottom wall of the ornamental plate 26 to impart an upward push force to the ornamental plate 26 toward the first position S1.

After understanding of the structural details of the safety structure 20, the functioning of the safety structure 20 is outlined hereinafter.

In the status shown in FIGS. 3~5, the sliding cover 24 is maintained in the closed position P1 to keep the control button 16 from sight. At this time, the sliding cover 24 protects the control button 16 from being touched accidentally, prohibiting false functioning of the ejecting mechanism of the pull handle 10 when the travel bag is hit or vibrated accidentally by an external force. At this time, the ornamental plate 26 is forced upwards by the spring members 28 to have the hooked portions 26*b* be stopped against the bottom wall of the holder member 22, and therefore the ornamental plate 26 is kept in the first position S1 flush with the top wall of the holder member 22 and the top wall of the sliding cover 24 that is kept in the close position P1.

Figure 8:
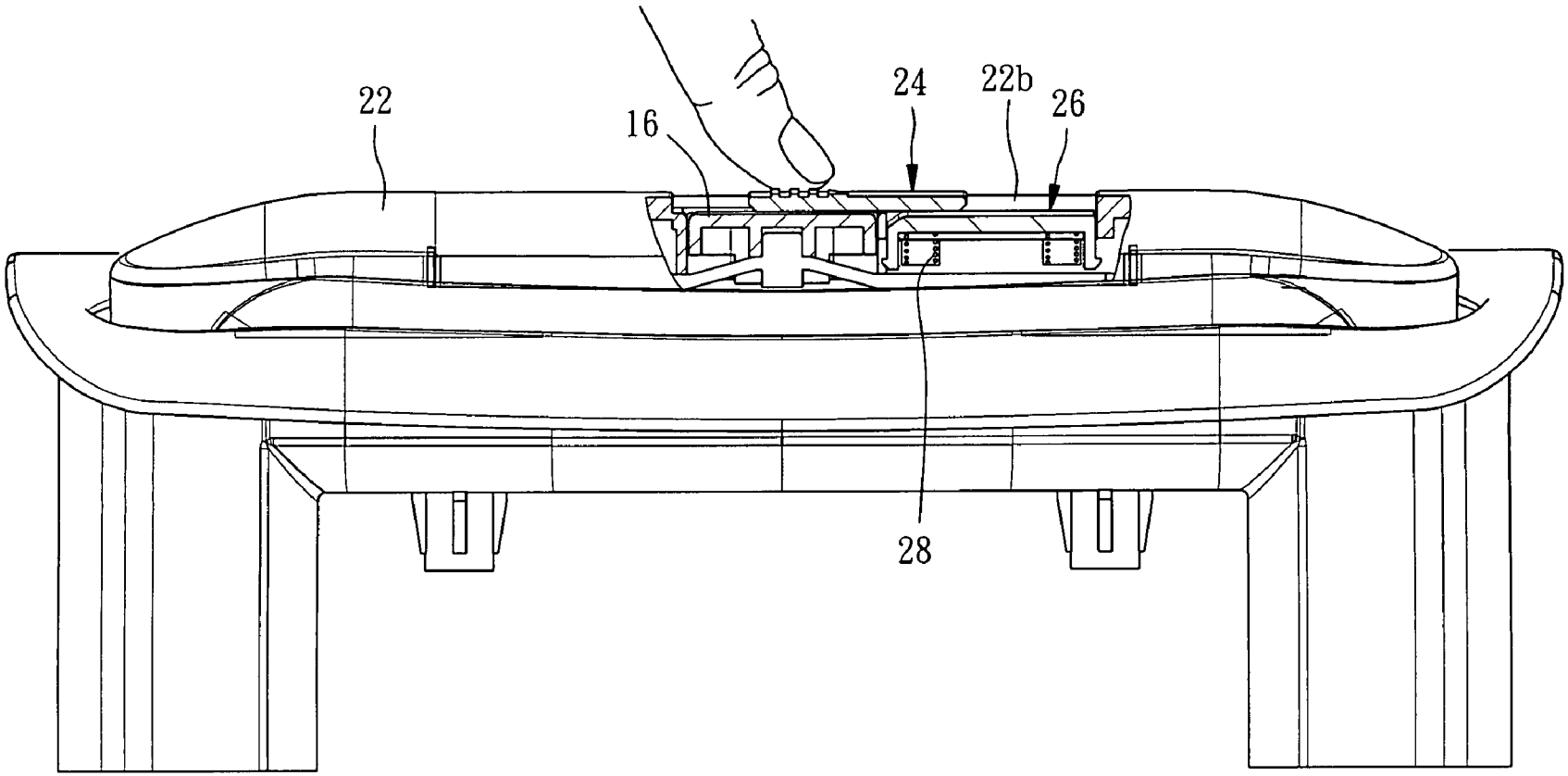
FIG. 8 is a schematic drawing of the present invention, showing the sliding cover pushed.

When wishing to hold the grip 14 of the pull handle 10, push the sliding cover 24 sideways in direction toward the ornamental plate 26 to force the beveled edge 24*b* of the sliding cover 24 against the beveled edge 26*c*, thereby lowering the ornamental plate 26, as shown in FIG. 8. When continuously pushing the sliding cover 24 sideways, the ornamental plate 26 is lowered to the second position S2. When the ornamental plate 26 is lowered to the second position S2, the sliding cover 24 is moved to the open position P2 shown in FIG. 9 and kept in this position by the upward spring force of the spring members 28. At this time, the user can press the control button 16 to unlock the ejecting mechanism, enabling the ejecting mechanism to eject the pull handle 10 out of the travel bag. When the pull handle 10 is ejected out of the travel bag, the user can then grasp the grip 14 of the pull handle 10 to pull the pull handle 10 to the extended position. On the contrary, the user can push the sliding cover 24 back to the status shown in FIG. 3.

In the aforesaid preferred embodiment, the ornamental plate 26 is mainly provided to keep the integrity of the outer appearance and to work with the spring members 28 in holding the sliding cover 22 in the open position P2. However, the invention is not limited to the use of the ornamental plate 26 and the spring members 28, i.e., the ornamental plate 26 and the spring members 28 can be eliminated from the safety structure 20, allowing the sliding cover 24 to be directly moved to the position above the opening 22*a* or the open chamber 22*b* to guard or not to guard the control button 16. Under this architecture, the open chamber 22*b* can be modified to a non-open design to accommodate the sliding cover 24 in the open position P2 and to keep it from sight.

Although a particular embodiment of the invention has been described in detail for purposes of illustration, various modifications and enhancements may be made without departing from the spirit and scope of the invention. Accordingly, the invention is not to be limited except as by the appended claims.

What is claimed is:

1. A safety structure installed in an auto-eject pull handle that is mounted in a travel bag and ejectable out of said travel bag to a predetermined elevation by an ejecting mechanism of said travel bag subject to the control of a control button, said safety structure comprising:

a holder member, said holder member comprising a sliding track, and an opening formed in said sliding track for accommodating said control button; and a sliding cover coupled to said sliding track and movable along said sliding track between a closed position where said sliding cover covers said opening to keep said control button from sight and an open position where said sliding cover is kept away from said opening to let said control button be exposed to the outside for operation;

wherein said holder member further comprises a chamber defined in said sliding track and adapted to accommodate said sliding cover in said open position; and further comprising:

an ornamental plate coupled to said holder member and movable relative to said holder member between a first position where said ornamental plate is abutted against one lateral side of said sliding cover to stop said sliding cover in said closed position and a second position where said ornamental plate is kept away from said sliding track for allowing movement of said sliding cover between said closed position and said open position.

2. The safety structure as claimed in claim 1, further comprising at least one elastic means adapted to impart a push force to said ornamental plate toward said first position.

3. The safety structure as claimed in claim 2, wherein said ornamental plate is movable in vertical direction relative to said holder member between said first position and said second position; said at least one elastic means each has a bottom side positioned in a bottom wall in said chamber and a top side stopped against a bottom wall of said holder member.

4. The safety structure as claimed in claim 3, wherein said ornamental plate comprises a beveled edge disposed at one lateral side thereof; said sliding cover comprises a beveled edge matching the beveled edge of said ornamental plate so that when pushing said sliding cover along said sliding track in direction against said ornamental plate, said ornamental plate is forced by the beveled edge of said sliding cover to move from said first position to said second position.

5. The safety structure as claimed in claim 3, wherein said holder member comprises at least one locating hole extending through said chamber; said ornamental plate comprises at least one bottom hook rod respectively inserted through said at least one locating hole, each said bottom hook rod having a hooked portion that is stopped against the bottom wall of said holder member when said ornamental plate is moved to said first position.

6. The safety structure as claimed in claim 1, wherein said sliding track of said holder member is comprised of two sliding grooves arranged in parallel at two sides relative to said opening; said sliding cover comprises two rails disposed at two opposite sides thereof and respectively coupled to said sliding grooves.

* * * * *